US008387527B2

(12) United States Patent
Huang

(10) Patent No.: US 8,387,527 B2
(45) Date of Patent: Mar. 5, 2013

(54) TRANSFER PRINTING MACHINE FOR TRANSFERRING PRINTING ON HOCKEY STICK

(75) Inventor: Kuo-Cheng Huang, Taichung County (TW)

(73) Assignee: Kai Hsing Industrial Co., Ltd., Taichung County (TW)

( * ) Notice: Subject to any disclaimer, the term of this patent is extended or adjusted under 35 U.S.C. 154(b) by 551 days.

(21) Appl. No.: 12/705,627

(22) Filed: Feb. 14, 2010

(65) Prior Publication Data

US 2011/0132211 A1 Jun. 9, 2011

(30) Foreign Application Priority Data

Dec. 4, 2009 (TW) ..... 98222807 U

(51) Int. Cl.
*B41F 17/16* (2006.01)
*B41F 17/24* (2006.01)

(52) U.S. Cl. ..... 101/35; 101/37

(58) Field of Classification Search ..... 101/35, 101/36, 37, 41, 492; *B41F 17/14, 17/16, B41F 17/24, 17/26*

See application file for complete search history.

(56) References Cited

U.S. PATENT DOCUMENTS 3,122,994 A * 3/1964 Crabtree et al. ..... 101/35

* cited by examiner

*Primary Examiner* — Leslie J Evanisko

(57) ABSTRACT

A transfer printing machine for hockey sticks include a base, a transmission unit connected to the lower portion of the base and five stations located on the top of the base. The five stations are located along the transmission direction of the transmission unit. The first station prints patterns on a top surface of a straight handle of the hockey sticks which are moved by the transmission unit. The second station prints patterns on a left side and a right side of the straight handle. The third station and the fourth station print patterns on a first inclined surface and a second inclined surface of the straight handle respectively. The fifth station prints patterns on a bottom surface of the straight handle of the hockey sticks.

12 Claims, 8 Drawing Sheets

TRANSFER PRINTING MACHINE FOR TRANSFERRING PRINTING ON HOCKEY STICK

FIELD OF THE INVENTION

The present invention relates to a transfer printing machine, and more particularly, to a transfer printing machine for printing patterns on the surface of hockey sticks.

BACKGROUND OF THE INVENTION

A conventional hockey stick is shown in FIGS. 1 and 2, and generally includes a substantially straight handle portion and a strike portion which is connected to an end of the handle portion. The handle portion has a substantially rectangular cross section which includes two inclined surfaces at two ridges portion of the handle portion as shown in FIG. 2.

There are patterns printed on the surface of the handle portion and the patterns are required to match on the surfaces of the handle portion. The conventional way to print the patterns on the surface of the handle portion including the inclined surfaces are processed in different machines, or the hockey stick has to flip in one printing machine so as to put the patterns on different sides of the handle portion. It takes a lot of time and the patterns cannot be perfectly printed on the surface by the conventional way.

The present invention intends to provide a transfer printing machine for printing patterns on the surface of hockey sticks. The transfer printing machine includes multiple work stations and the hockey stick is moved to the stations one by one to finish the printing process for different side of the hockey stick.

SUMMARY OF THE INVENTION

The present invention relates to a transfer printing machine for hockey sticks, and comprises a base with a transmission unit connected to the lower portion thereof and the transmission unit transfers multiple hockey sticks. A first station, a second station, a third station, a fourth station and a fifth station are connected to the base and located along a transmission direction of the transmission unit. The first station is connected to the top of the base and includes a top transfer printing unit so as to print patterns on a top surface of a straight handle of the hockey sticks. The second station is connected to the top of the base and includes a side transfer printing unit so as to print patterns on a left side and a right side of the straight handle of the hockey sticks. The third station and the fourth station are connected to the lower portion of the base respectively and each have a surface transfer printing unit so as to print patterns on a first inclined surface and a second inclined surface of the straight handle of the hockey sticks. The fifth station is connected to the lower portion of the base and includes a bottom transfer printing unit so as to print patterns on a bottom surface of the straight handle of the hockey sticks.

The transmission unit includes chains and chainwheels, and includes a first positioning member and a second positioning member which is located at a distance from the first positioning member. The hockey stick is connected between the first and second positioning members. An end of the straight handle is secured on the first positioning member and an underside of a strike portions is secured on the second positioning member.

The first station includes a first lift unit which is fixed on the top of the base, the top transfer printing unit is moved by the first lift unit. The first station includes a support platform which is fixed on the lower portion of the base. The support platform is moved by a dynamic cylinder unit.

The second station includes a second lift unit which is fixed on the top of the base, and two side transfer printing united are moved by the second lift unit. The second station includes a support platform which is fixed on the lower portion of the base, and the support platform is moved by a dynamic cylinder unit.

The third station has a third lift unit and the fourth station has a fourth lift. The third and fourth lift units are fixed to the top of the base and each of the third and fourth lift units has a presser connected to a lower end thereof. Each of the third and fourth lift units has a film adjustment member connected thereto.

Each of the surface transfer units includes a heating member and a dynamic cylinder unit. Two transfer printing wheels are respectively moved by the dynamic cylinder units. Two linear movement units drive the dynamic cylinder units between a first position and a second position. The first position sets the transfer printing wheel to be heated in the heating member, and the second position sets the transfer printing wheel to be located corresponding to the hockey sticks.

The fifth station includes a fifth lift unit on the top of the base and the fifth lift unit is connected with a presser. The bottom transfer printing unit includes a heating member and a dynamic cylinder unit. A transfer printing wheel is moved by the dynamic cylinder unit. A linear movement unit drives the dynamic cylinder unit between a first position and a second position. The first position sets the transfer printing wheel to be heated in the heating member, and the second position sets the transfer printing wheel to be located corresponding to the hockey sticks.

The primary object of the present invention is to provide a transfer printing machine for printing patterns on the surface of hockey sticks, wherein the sticks are moved to the stations of the machine so that different surfaces of the sticks are printed efficiently.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 3:
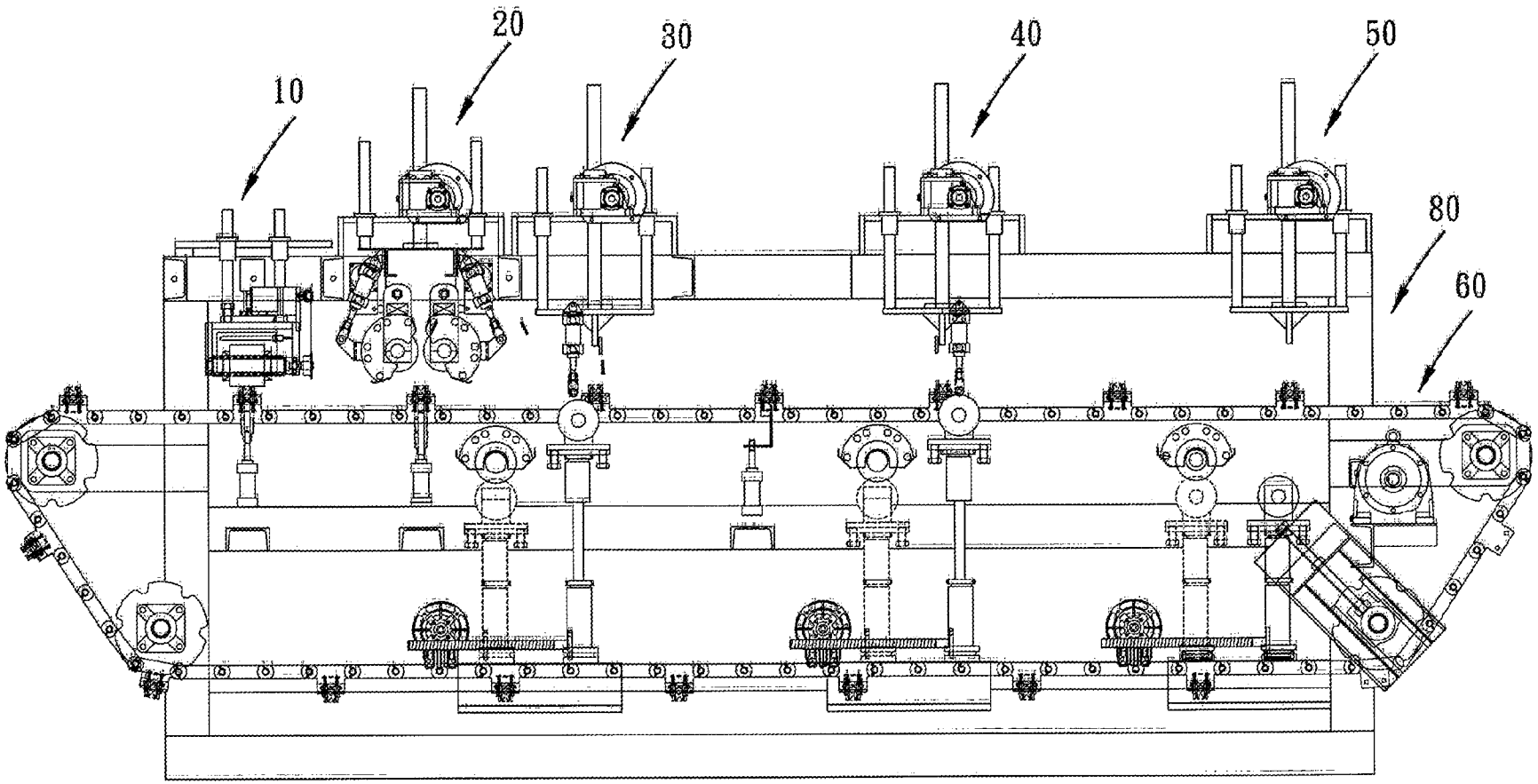
FIG. 3 shows the transfer printing machine of the present invention.
Figure 4:
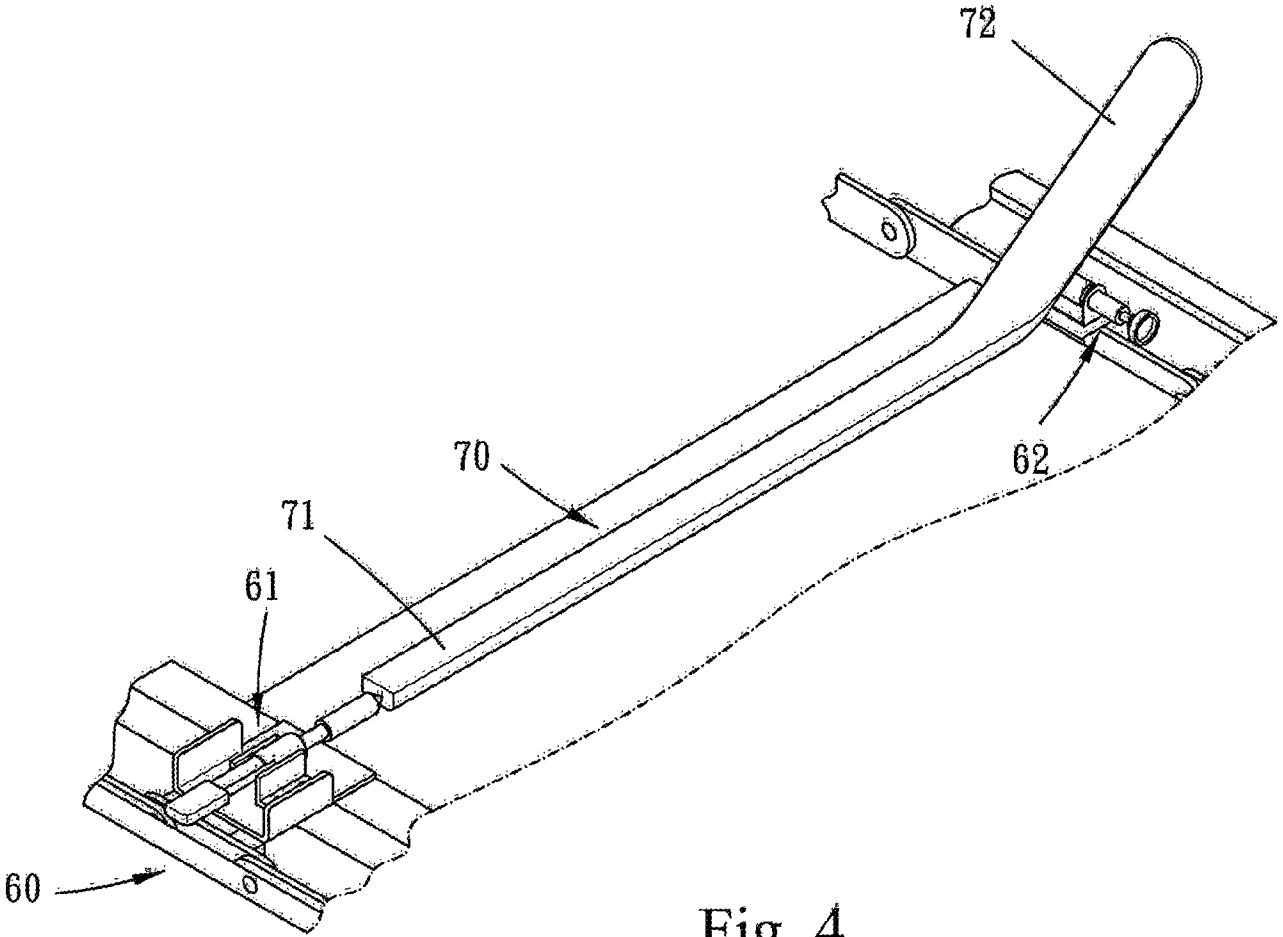
FIG. 4 shows that the hockey stick is secured on the transfer printing machine of the present invention.

Referring to FIGS. 3 and 4, the transfer printing machine for hockey sticks of the present invention comprises a base 80, a transmission unit 60 connected to the lower portion of the base 80, and a first station 10, a second station 20, a third station 30, a fourth station 40 and a fifth station 50 connected to the base 80 and located along a transmission direction of the transmission unit 60.

Figure 2:
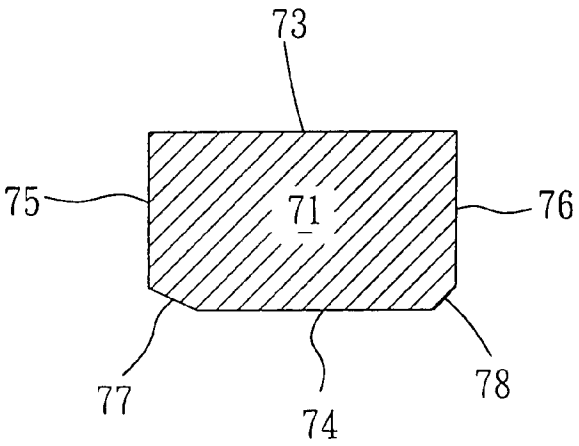
Fig. 2 Prior Art
FIG. 2 shows the cross sectional view of the hockey stick.
Figure 1:
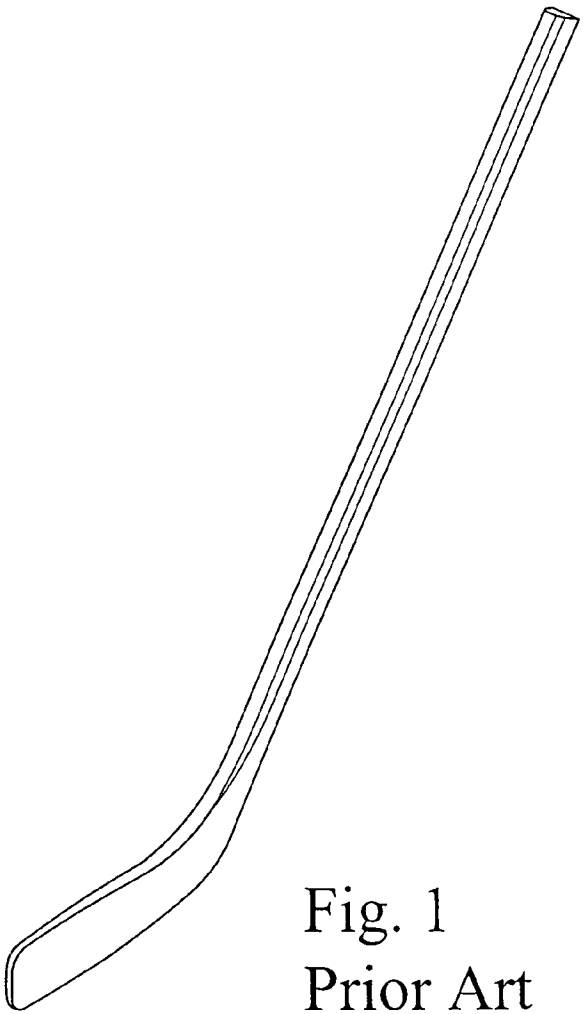
Fig. 1 Prior Art
FIG. 1 is a perspective view to show a hockey stick.

The transmission unit 60 includes chains and chainwheels, and the transferring member of the transmission unit 60 includes a first positioning member 61 and a second positioning member 62 which is located at a distance from the first positioning member 61. The hockey stick 70 is connected between the first and second positioning members 61, 62, wherein an end of the straight handle 71 is secured on the first positioning member 61 and an underside of a strike portion 72 is secured on the second positioning member 62. As shown in FIG. 2, the straight handle 71 of the hockey stick 70 includes a substantially rectangular cross section which includes the top surface 73, the bottom surface 74, the left side 75, the right side 76, the first inclined surface 77 and the second inclined surface 78. The first station 10 prints patterns on the top surface 73 of the straight handle 71 of the hockey sticks 70, the second station 20 prints patterns on the left side 75 and the right side 76 of the straight handle 71 of the hockey sticks 70, the third station 30 and the fourth station 40 print patterns on the first inclined surface 77 and the second inclined surface 78 of the straight handle 71 of the hockey sticks 70, and the fifth station 50 prints patterns on the bottom surface 74 of the straight handle 71 of the hockey sticks 70.

Figure 5:
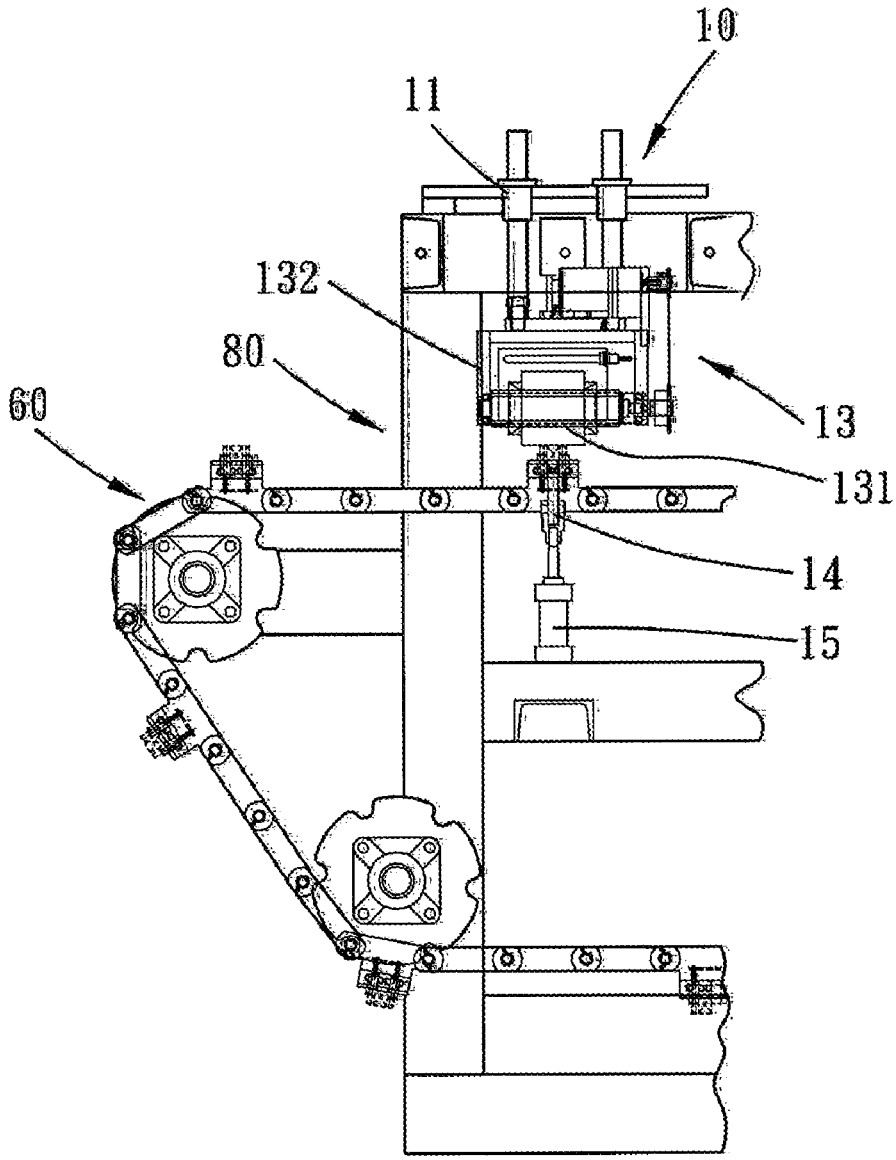
FIG. 5 is an enlarged view to show the first station of the transfer printing machine of the present invention.

As shown in FIGS. 3 and 5, the first station 10 is connected to the top of the base 80 and includes a top transfer printing unit 13 which is moved up and down by a first lift unit 11 fixed on the top of the base 80. The top transfer printing unit 13 includes a heating member 132 and a transfer printing wheel 131. The first station 10 includes a support platform 14 which is fixed on the lower portion of the base 80, and the support platform 14 is moved by a dynamic cylinder unit 15. The transferring unit 60 moves the hockey stick 70 to the first station 10 and the bottom surface 74 of the hockey stick 70 is supported by the support platform 14. The top transfer printing unit 13 moves along the axis of the hockey stick 70 and the transfer printing wheel 131 prints patterns on the top surface 73 of the hockey stick 70.

Figure 6:
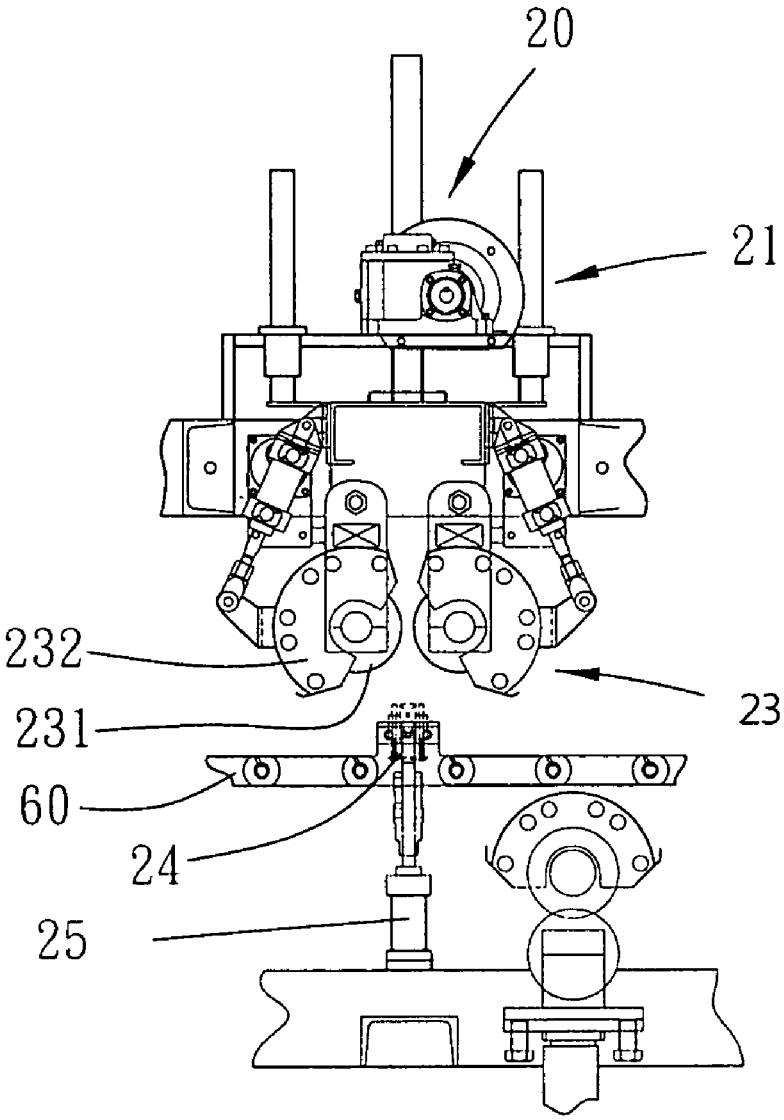
FIG. 6 is an enlarged view to show the second station of the transfer printing machine of the present invention.

As shown in FIGS. 3 and 6, the second station 20 is connected to the top of the base 80 and includes two side transfer printing units 23 which are moved up and down by a second lift unit 21 fixed on the top of the base 80. Each of the side transfer printing units 23 includes a heating member 232 and a transfer printing wheel 231. The second station 20 includes a support platform 24 which is fixed on the lower portion of the base 80, and the support platform 24 is moved by a dynamic cylinder unit 25. After the printing process on the top surface 73 is finished, the transferring unit 60 moves the hockey stick 70 to the second station 20 and the bottom surface 74 of the hockey stick 70 is supported by the support platform 24. The transfer printing wheel 231 has the same length of that of the straight handle 71 of the hockey stick 70, and the two side transfer printing units 23 are moved downward by the second lift unit 21 so as to print patterns on the left and right sides 75, 76 of the hockey stick 70 simultaneously.

Figure 7:
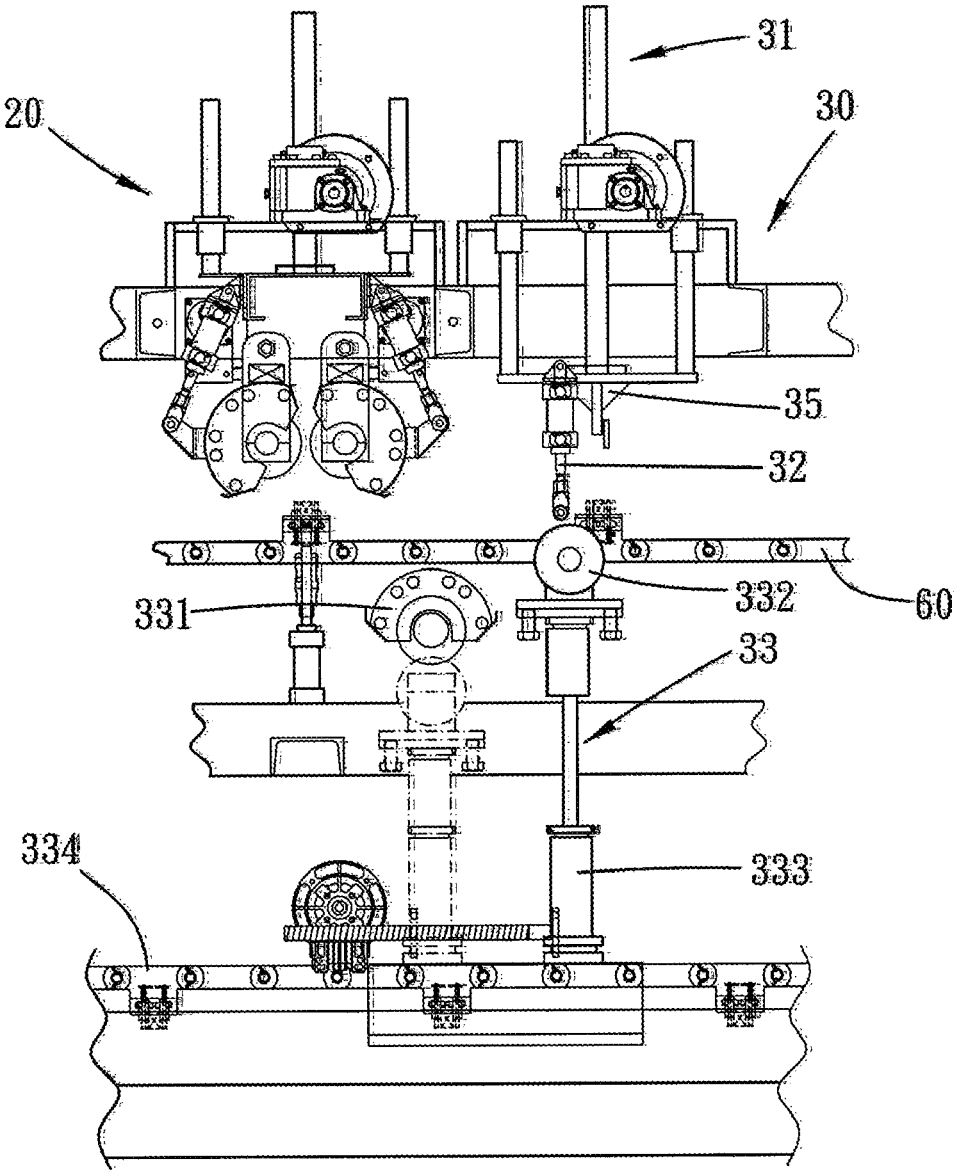
FIG. 7 is an enlarged view to show the third station of the transfer printing machine of the present invention.
Figure 8:
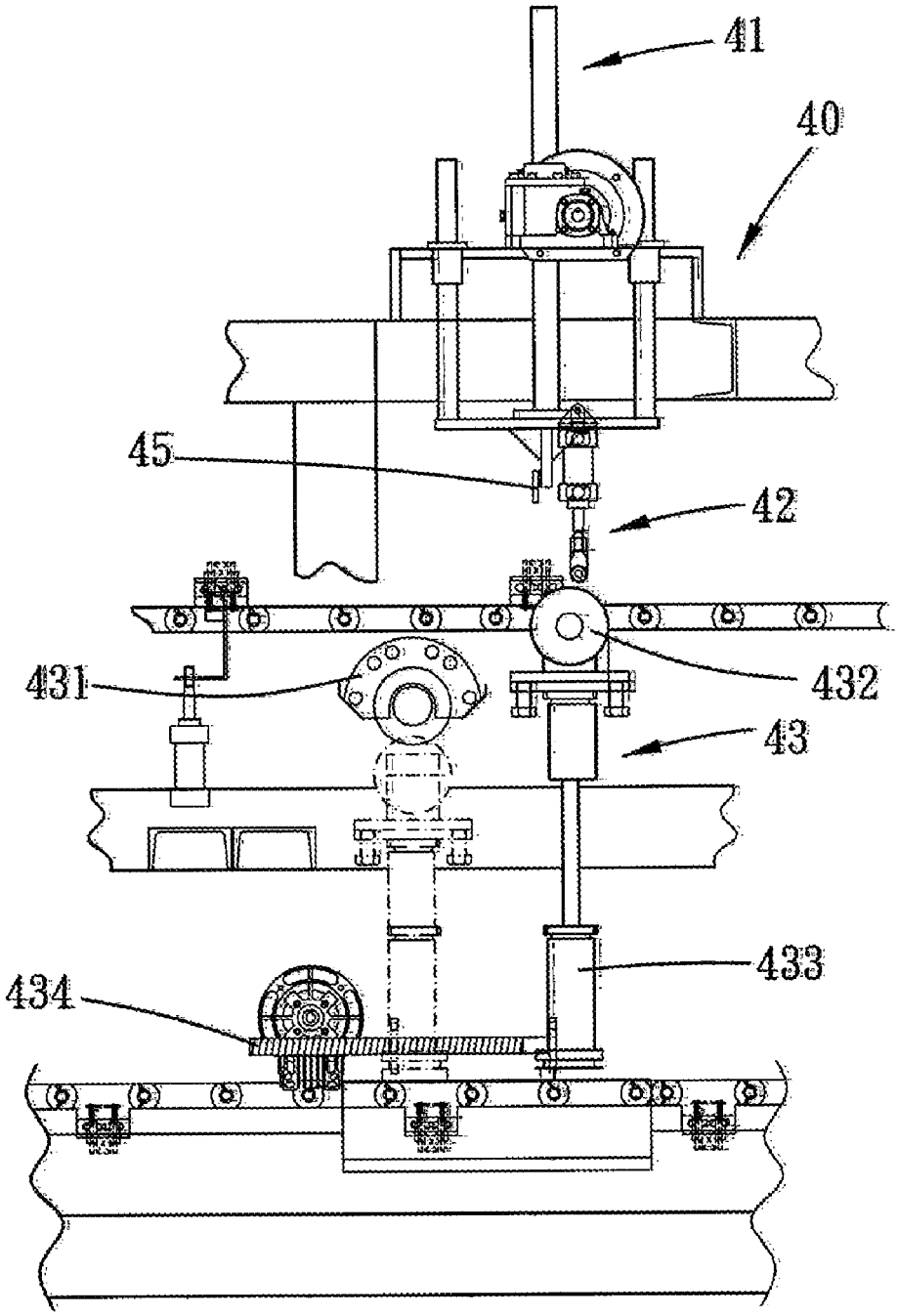
FIG. 8 is an enlarged view to show the fourth station of the transfer printing machine of the present invention.

FIGS. 3, 7 and 8 show that the third station 30 has a third lift unit 31 and the fourth station 40 has a fourth lift 41. The third and fourth lift units 31, 41 are fixed to the tap of the base 80, and each of the third and fourth lift units 31, 41 has a presser 35/45 connected to a lower end thereof. Two pressers 35, 45 are connected to the third and fourth lift units 31, 41 respectively. Each of the third and fourth lift units 31, 41 has a film adjustment member 32/42 connected thereto. The third station 30 and the fourth station 40 are connected to the lower portion of the base 80 and each have a surface transfer printing unit 33/43 so as to print patterns on a first inclined surface 77 and a second inclined surface 78 of the straight handle 71 of the hockey sticks 70. Each of the surface transfer units 33, 43 includes a heating member 331/431 and a dynamic cylinder unit 333/433. Two transfer printing wheels 332, 432 are respectively moved by the dynamic cylinder units 333, 433. The two transfer printing wheels 332, 432 each have the same length as that of the axial length of the straight handle 71. Two linear movement units 334, 434 drive the dynamic cylinder units 333, 433 between a first position and a second position, wherein the first position sets the transfer printing wheel 332/432 to be heated in the heating member 331/431, and the second position sets the transfer printing wheel 332/432 to be located corresponding to the hockey sticks 70.

After the printing processes on the lei and right sides 73, 76 of the hockey stick 70 are finished, the transmission unit 60 moves the hockey stick 70 to the third station 30. The presser 35 presses the top surface 73 of the straight handle 71 and the linear movement unit 334 moves the dynamic cylinder unit 333 from the first position to the second position. The dynamic cylinder unit 333 drives the transfer printing wheel 332 upward so as to print patterns on the first inclined surface 77. The film adjustment member 32 cuts the film and trims the edges of the film.

After the printing process on the first inclined surface 77 is finished, the hockey stick 70 is moved to the fourth station which operates the same as those at the third station to print patterns on the second inclined surface 78.

Figure 9:
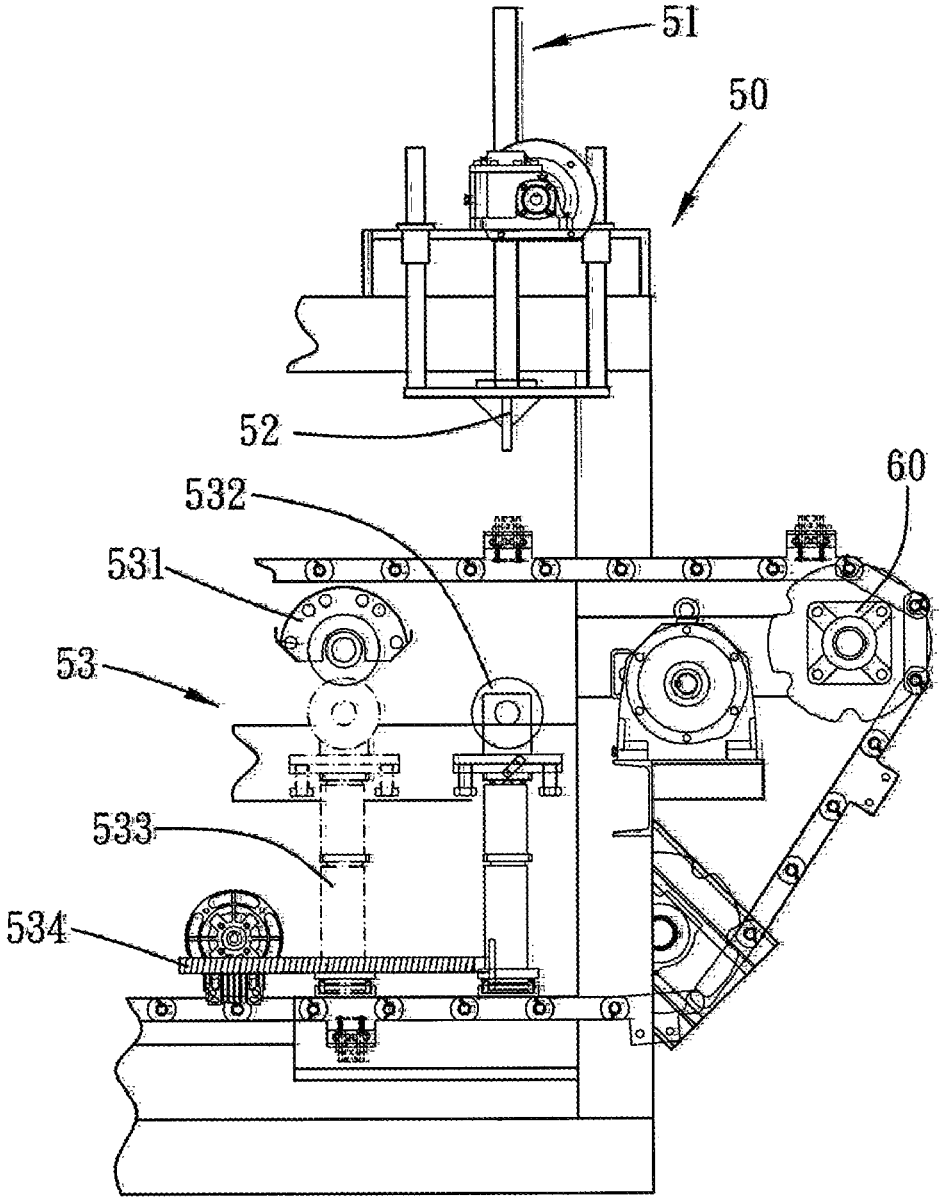
FIG. 9 is an enlarged view to show the fifth station of the transfer printing machine of the present invention.

As shown in FIGS. 3 and 9, the fifth station 50 includes a fifth lift unit 51 on the top of the base 80, a presser 52 driven by the fifth lift unit 51, and a bottom transfer printing unit 53 fixed to the lower portion of the base 80. The bottom transfer printing unit 53 includes a heating member 531, a transfer printing wheel 532, dynamic cylinder unit 533 and a linear movement member 534. The heating member 531 is connected to the lower portion of the base 80 and the transfer printing wheel 532 is driven by the dynamic cylinder unit 533. The transfer printing wheel 532 has the same length as that of the axial length of the straight handle 71 and the linear movement member 534 controls the movement between the first and second positions of the dynamic cylinder unit 533. The first position sets the transfer printing wheel 532 to be heated in the heating member 531, and the second position sets transfer printing wheel 532 to be located corresponding to the hockey sticks 70.

After the printing process on the second inclined surface 78 is finished, the transmission unit 60 moves the hockey stick 70 to the fifth station 50, and the presser 52 presses the top surface 73 of the straight handle 71. The dynamic cylinder unit 533 is moved from the first position to the second position by the linear movement unit 534. The dynamic cylinder unit 533 moves the transfer printing wheel 532 upward to print patterns on the bottom surface 74.

The hockey stick 70 is moves in sequence by the transmission unit 60 from the first station 10 to the fifth station 50, and the top surface 73, the left side 75, the right side 76, the first inclined surface 77, the second inclined surface 78 and the bottom surface 74 are printed respectively. After the hockey stick 70 moves to the fifth station 50, the printing processes are finished.

While we have shown and described the embodiment in accordance with the present invention, it should be clear to those skilled in the art that further embodiments may be made without departing from the scope of the present invention.

What is claimed is:

1. A transfer printing machine for hockey sticks, comprising:

a base (80);

a transmission unit (60) connected to the lower portion of the base (80) and the transmission unit (60) transferring multiple hockey sticks (70);

a first station (10), a second station (20), a third station (30), a fourth station (40) and a fifth station (50) connected to the base (80) and located along a transmission direction of the transmission unit (60);

the first station (10) connected to the top of the base (80) and including a top transfer printing unit (13) so as to print patterns on a top surface (73) of a straight handle (71) of each of the hockey sticks (70);

the second station (20) connected to the top of the base (80) and including a side transfer printing unit (23) so as to print patterns on a left side (75) and a right side (76) of the straight handle (71) of each of the hockey sticks (70);

the third station (30) and the fourth station (40) connected to the lower portion of the base (80) and each having a surface transfer printing unit (33/43) so as to print patterns on a first inclined surface (77) and a second inclined surface (78) of the straight handle (71) of each of the hockey sticks (70), and the fifth station (50) connected to the lower portion of the base (80) and including a bottom transfer printing unit (53) so as to print patterns on a bottom surface (74) of the straight handle (71) of each of the hockey sticks (70).

2. The machine as claimed in claim 1, wherein the transmission unit (60) includes chains and chainwheels.

3. The machine as claimed in claim 2, wherein the transmission unit (60) includes a first positioning member (61) and a second positioning member (62) which is located at a distance from the first positioning member (61), each hockey stick (70) is connected between the first and second positioning members (61, 62), an end of the straight handle (71) is secured on the first positioning member (61) and an underside of a strike portion (72) is secured on the second positioning member (62).

4. The machine as claimed in claim 1, wherein the first station (10) includes a first lift unit (11) which is fixed on the top of the base (80), the top transfer printing unit (13) is moved by the first lift unit (11).

5. The machine as claimed in claim 1, wherein the first station (10) includes a support platform (14) which is fixed on the lower portion of the base (80), the support platform (14) is moved by a dynamic cylinder unit (15).

6. The machine as claimed in claim 1, wherein the second station (20) includes a second lift unit (21) which is fixed on the top of the base (80), the two side transfer printing units (23) being moved by the second lift unit (21).

7. The machine as claimed in claim 6, wherein the second station (20) includes a support platform (24) which is fixed on the lower portion of the base (80), the support platform (24) is moved by a dynamic cylinder unit (25).

8. The machine as claimed in claim 1, wherein the third station (30) has a third lift unit (31) and the fourth station (40) has a fourth lift unit (41), the third and fourth lift units (31, 41) are fixed to the top of the base (80), each of the third and fourth lift units (31, 41) has a presser (35/45) connected to a lower end thereof.

9. The machine as claimed in claim 8, wherein each of the third and fourth lift units (31, 41) has a film adjustment member (32/42) connected thereto.

10. The machine as claimed in claim 1, wherein each of the surface transfer units (33, 43) includes a heating member (331/431) and a dynamic cylinder unit (333/433), two transfer printing wheels (332, 432) are respectively moved by the dynamic cylinder units (333, 433), two linear movement units (334, 434) drive the dynamic cylinder units (333, 433) between a first position and a second position, the first position sets each of the transfer printing wheels (332, 432) to be heated in the heating member (331/431), the second position sets each of the transfer printing wheels (332, 432) to be located corresponding to the hockey sticks (70).

11. The machine as claimed in claim 1, wherein the fifth station (50) includes a fifth lift unit (51) on the top of the base (80) and the fifth lift unit (51) is connected with a presser (52).

12. The machine as claimed in claim 1, wherein the bottom transfer printing unit (53) includes a heating member (531) and a dynamic cylinder unit (533), a transfer printing wheel (532) is moved by the dynamic cylinder unit (533), a linear movement unit (534) drives the dynamic cylinder unit (533) between a first position and a second position, the first position sets the transfer printing wheel (532) to be heated in the heating member (531), the second position sets the transfer printing wheel (532) to be located corresponding to the hockey sticks (70).

* * * * *